US005359393A

United States Patent [19]

Folkins

[11] Patent Number: 5,359,393

[45] Date of Patent: Oct. 25, 1994

[54] METHOD AND APPARATUS FOR MEASURING PHOTORECEPTOR VOLTAGE POTENTIAL USING A CHARGING DEVICE

[75] Inventor: Jeffrey J. Folkins, Rochester, N.Y.

[73] Assignee: Xerox Corporation, Stamford, Conn.

[21] Appl. No.: 995,260

[22] Filed: Dec. 22, 1992

[51] Int. Cl.[5] ..... G03G 21/00

[52] U.S. Cl. ..... 355/208; 250/324; 324/455; 324/713; 355/221; 355/225; 361/225

[58] Field of Search ..... 355/203, 208, 219, 221, 355/225, 228, 246, 326, 328; 361/225, 230; 250/324–326; 324/455, 713

[56] References Cited

U.S. PATENT DOCUMENTS

| | | | |
|---|---|---|---|
| 3,851,229 | 11/1974 | Hayne et al. | 324/455 X |
| 3,908,164 | 9/1975 | Parker | 361/230 |
| 4,791,452 | 12/1988 | Kasai et al. | 355/326 |
| 4,800,337 | 1/1989 | Cox et al. | 324/455 |
| 4,801,967 | 1/1989 | Snelling | 250/325 X |
| 4,833,503 | 5/1989 | Snelling | 355/326 X |
| 4,998,139 | 3/1991 | May et al. | 355/208 |
| 5,159,388 | 10/1992 | Yoshiyama et al. | 355/208 |
| 5,173,734 | 12/1992 | Shimizu et al. | 355/208 |
| 5,243,383 | 9/1993 | Parisi | 355/208 |
| 5,258,820 | 11/1993 | Tabb | 355/208 X |

*Primary Examiner*—A. T. Grimley
*Assistant Examiner*—William J. Royer
*Attorney, Agent, or Firm*—Oliff & Berridge

[57] ABSTRACT

A photoreceptor charging device, already provided in an electrophotographic printing machine, is used to determine the voltage potential of a portion of the photoreceptor located adjacent to the photoreceptor charging device. In particular, an operating condition of the photoreceptor charging device, such as, for example, the total current supplied to a coronode and to a grid of the photoreceptor charging device, or the voltage potential of the grid of the photoreceptor charging device when the total current is a predetermined, relatively small value, is used to determine the voltage potential of the photoreceptor adjacent to the charging device.

47 Claims, 3 Drawing Sheets

METHOD AND APPARATUS FOR MEASURING PHOTORECEPTOR VOLTAGE POTENTIAL USING A CHARGING DEVICE

BACKGROUND OF THE INVENTION

1. Field of the Invention

The present invention relates to methods and apparatus for measuring the voltage potential of a charged photoreceptor, and in particular to methods and apparatus for measuring the voltage potential of a charged photoreceptor in a xerographic imaging device capable of printing images having two or more colors.

2. Description of Related Art

A typical electrophotographic printing machine (such as a photocopier, laser printer, facsimile machine or the like) employs an imaging member (e.g., a photoreceptor) that is exposed to an image to be printed. Exposure of the imaging member records an electrostatic image on it corresponding to the informational areas contained within the image to be printed. The latent image is developed by bringing a developer material (liquid or powder)into contact with the latent image. The developed image (toner image) recorded on the imaging member is transferred to a support material such as paper either directly or via an intermediate transport member. The developed image on the support material is generally subjected to heat and/or pressure to permanently fuse the image to the support material.

Multicolor printing machines include printing machines which can print with highlight color (usually black and one other color such as, for example, red, green or blue) and machines which can print with process color (usually four different colors, such as black, yellow, magenta and cyan).

There is a class of color printer which builds up multicolor images of toner on the photoreceptor and then transfers this multicolor toner image in one step, as opposed to multiple transfer steps of the individual colors separately. Within this transfer class of color machines there are two types of multicolor electrophotographic printing machines which are typically employed to form highlight or process color images. One type of single transfer multicolor electrophotographic printing machine is known as a multi-pass color printer. The multi-pass color printer typically has an imaging member (such as, for example, a photoreceptive drum or belt) having a single charger (for charging the imaging member to a uniform voltage potential), exposure device (for forming a latent image on the charged imaging member)and developer device (for developing the latent image into a toner image). In order to form multicolor images, the imaging member must rotate multiple times (i.e., one time for each color in the image). The second type of single transfer multicolor printer is known as a single pass multicolor printer. The single pass printer includes a plurality of charging devices, exposing devices, and developing devices located around the periphery of the photoreceptor, and corresponding in number to the total number of colors to be formed in the image. For example, a single pass printer capable of highlight color printing could include two sets of charging devices, exposing devices and developer devices, while a single pass printer capable of printing images with four colors would include four sets of charging devices, imaging devices and developer devices.

U.S. Pat. Nos. 4,833,503 to Snelling (Xerox Corporation) and 4,791,452 to Kasai et al. (Toshiba) illustrate single pass multicolor electrostatic printing machines which include a plurality of charging, exposing, and developing devices corresponding in number to the total number of colors in the final image. Accordingly, U.S. Pat. Nos. 4,833,503 and 4,791,452 are incorporated herein by reference in their entireties.

Typically, multicolor electrophotographic printing machines form the single color component images of a multicolor image on top of each other. In other words, the latent image for the second component color is formed directly over the toner image of the first component color, etc. During each exposure operation, the portion of the photoreceptor which is not exposed to light (typically referred to as background areas), are not discharged, and ideally should remain at the voltage potential to which the photoreceptor was charged by the previous charging device. However, all photoreceptors are somewhat conductive, and therefore experience a decrease in voltage potential over time even when they are not exposed to light. This decrease in voltage potential is known as dark decay. It is important to know the dark decay characteristics of a photoreceptor, especially in multicolor printing machines, for example, so that the photoreceptor can be recharged to a proper voltage potential (for forming second, third, fourth, etc. component images of a multicolor image) so that the exposure devices can be set at the proper light intensity, and so that the bias voltage of the developer devices can be set at a proper level. Additionally, the dark decay characteristics of the photoreceptor should be monitored over time because they change as the photoreceptor ages and is used a large number of times.

In order to determine the voltage potential of a photoreceptor at points of interest (e.g., the point of recharging, the point of light exposure, the point of development, etc.), some printing machines include devices for directly measuring the voltage potential of the photoreceptor at these points. For example, U.S. Pat. No. 4,998,139 to May et al. (Xerox Corporation), the disclosure of which is incorporated herein by reference, uses an electrostatic voltmeter (ESV) between the exposing device and the developer devices in a tri-level printing machine. The photoreceptor potential measured by the ESV is used to control the ROS device which exposes the photoreceptor to a light image. Additionally, the abovementioned U.S. Pat. No. 4,791,452 includes sensors after each of its two charging devices in order to determine the voltage potential of the photoreceptor at these points.

However, conventional devices for measuring the voltage potential of a photoreceptor, such as the above-described electrostatic voltmeters, are expensive. Accordingly, many commercial devices do not include ESVs. For example, the Panasonic FPC-1and the Konica 8028/9028 do not include ESVs. In such products, a service technician sets up the printer by hand, with the hope that there will be no variations, drifts, etc. over time and between copies. The penalty for such measures can be poor print quality stability and maintenance.

The quality of color images produced by printers which do not include ESVs, however, degrades over time as the dark decay characteristics of the photoreceptor changes.

SUMMARY OF THE INVENTION

It is an object of the present invention to provide for the low cost determination of the state of the photoreceptor voltage potential.

It is another object of the present invention to use structure already existing in electrophotographic printing machines for determining the state of the photoreceptor voltage potential.

It is a further object of the present invention to provide for the determination of the state of the photoreceptor voltage potential without the use of electrostatic voltmeters.

In order to achieve the above and other objects, and to overcome the shortcomings set forth above, a photoreceptor charging device, already provided in an electrophotographic printing machine, is used to determine the voltage potential of a portion of the photoreceptor located adjacent to the photoreceptor charging device. In particular, an operating condition of the photoreceptor charging device, such as, for example, the total current supplied to the photoreceptor from the charging device or the voltage potential of a grid of the photoreceptor charging device when the total current supplied to the charging device is a relatively small, predetermined value, is used to determine the voltage potential of the photoreceptor adjacent to the charging device.

For example, in a single pass printing machine having two or more charging devices, operating conditions of the charging device (also referred to as a recharging device)located between two developing devices (i.e., downstream of the first charging, exposing and developing devices) are used to determine the photoreceptor voltage potential adjacent to the recharging device when the recharging device is operated to charge an unexposed portion of the photoreceptor to a voltage potential substantially equal to the voltage potential to which the first charging device charged the photoreceptor. The voltage potential of the unexposed portion of the photoreceptor input to the recharging device provides a measure of the dark decay of the photoreceptor between the first charging device and the recharging device.

Once the amount of dark decay which occurred between the first charging device and the recharging device is known, the voltage potential of the photoreceptor at other locations along the photoreceptor can be determined (i.e., predicted) based upon known characteristics of the photoreceptor. Accordingly, various parameters, such as, for example, exposure levels, development biases and recharging device voltage potentials, can be controlled to maintain a high printing quality because the photoreceptor voltage potential at the points where these operations take place can be accurately measured and/or predicted.

Similar measurements and control can be performed in a multi-pass color printing machine. However, many multi-pass printing machines include only a single charging device. In order to determine the dark decay characteristics of the photoreceptor in a multi-pass printing machine having a single charging device, the charging device is operated to charge the photoreceptor to a constant first voltage potential (it is understood that during normal, printing operation, the charging device may be operated to charge the photoreceptor to different voltage potentials depending on which color is being formed). When a portion of the photoreceptor which was charged to the first voltage potential a first time by the charging device, but has not been exposed to light, recirculates to the charging device (this can be done by allowing the photoreceptor to circulate without forming latent images thereon, or by using portions of the photoreceptor located between latent images formed on the photoreceptor), the measurements described above are made in order to determine the amount of dark decay occurring in the photoreceptor during the time required for the photoreceptor to complete one cycle. Using this information, the dark decay characteristics of the photoreceptor can be derived, and exposure levels, developer biases, recharging voltage potentials, and other parameters can be appropriately set for each cycle of the photoreceptor.

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENTS

Figure 1:
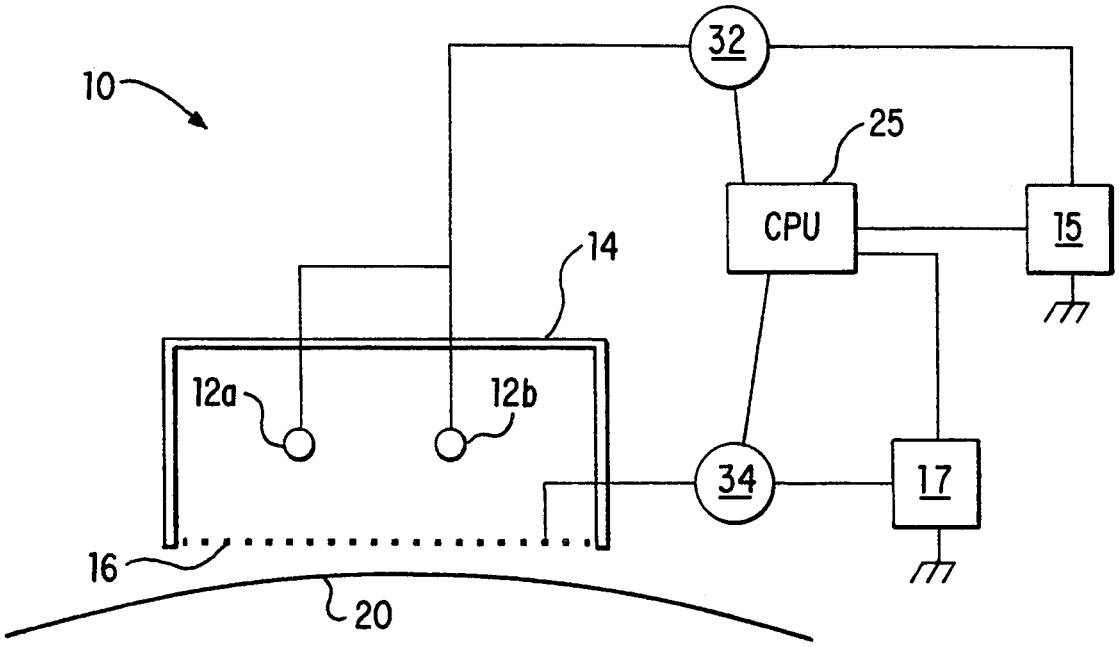
FIG. 1 is an enlarged schematic elevational view of a photoreceptor charging device and an arrangement for monitoring operating conditions of the photoreceptor charging device in accordance with one embodiment of the present invention.

FIG. 1 schematically illustrates a photoreceptor charging device 10 which can be, for example, a scorotron, corotron or dicorotron, as are well known in the art. Charging device 10 is located closely adjacent to a photoreceptor 20, and includes two coronodes 12*a*, 12*b* located in a shield 14 having a screen or grid 16 over an opening in shield 14 between coronodes 12*a*, 12*b* and photoreceptor 20. A coronode power supply 15 supplies power to coronodes 12*a*, 12*b*. A grid power supply 17 supplies power to grid 16. As is well understood in the art, charging device 10 operates to charge photoreceptor 20 to a voltage potential ($V_{P/R}$) substantially equal to the voltage potential ($V_{GR}$)created at grid 16 by grid power supply 17. The grid power supply 17 voltage to grid 16 usually remains constant so that grid 16 is maintained at a substantially constant potential (the approximate potential to which the photoreceptor is to be charged). The current flowing from coronode power supply 15 is $I_{COR}$. When the voltage potential of photoreceptor 20 and grid 16 are substantially equal, the sum of the coronode current ($I_{COR}$) and the grid current ($I_{GR}$)is negligible. That is, $I_{TOT}=I_{COR}+I_{GR}=0$ ($I_{COR}$ and $I_{GR}$ have opposite signs). When the incoming voltage potential of photoreceptor 20 is less than the voltage potential of grid 16, then $|I_{COR}|>|I_{GR}|$(i.e., $I_{TOT}\neq 0$) and the outgoing portion of photoreceptor 20 is charged to a potential substantially equal to the voltage potential of grid 16.

The present invention makes use of this characteristic of charging devices in order to determine the voltage potential of the photoreceptor adjacent to the charging device. When a portion of the photoreceptor is charged to a first voltage potential a first time and then a second time after the first time (i.e., the portion of the photoreceptor is charged to the same voltage potential twice), without exposing the portion of the photoreceptor to light between the first and second charging operations, the difference between the detected photoreceptor voltage potential (during the second charging operation) and the voltage potential to which the photoreceptor was initially charged (during the first charging operation) represents the drop in voltage potential due to dark decay. Since the period of time which elapsed between the first and second charging operations is known, the dark decay characteristic of the photoreceptor can be derived from the photoreceptor voltage potential measured the second time the portion of the photoreceptor is charged to the first voltage potential.

As shown in FIG. 1, current measuring devices such as, for example, ammeters 32, 34 are provided to measure the current supplied to coronodes 12*a*, 12*b* ($I_{COR}$) and grid 16 ($I_{GR}$), respectively. A controller such as, for example, a CPU 25 (conventionally provided in order to control coronode power supply 15 and grid power supply 17, as well as other components of the printing machine) receives the current measurements made by ammeters 32, 34 for use in determining the voltage potential of photoreceptor 20 adjacent to charging device 10.

Figure 2:
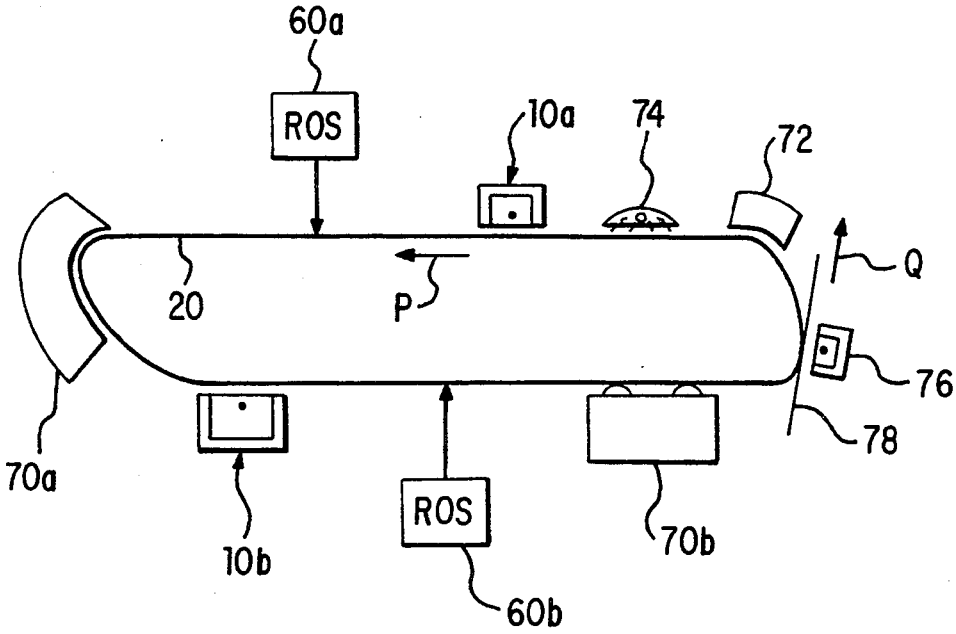
FIG. 2 is a schematic elevational view of a multicolor printer having two sets of charging devices, exposing devices and developer devices.

For an example of an application of the present invention to a single pass multicolor printing machine for forming a two colored image during a single cycle (revolution) of a photoreceptor, reference is now made to FIG. 2. The multicolor printing machine of FIG. 2 includes an endless photoreceptor in the form of a belt 20 having a first charging device 10*a*, a first exposing device 60*a* which can be, for example, a ROS, a first developing device 70*a*, a second charging device 10*b*, a second exposing device 60*b* and a second developing device 70*b* disposed around the periphery of photoreceptor 20. Belt 20 moves in a direction of arrow P to advance successive portions of the photoconductive surface sequentially through the various processing stations disposed about the path of movement of belt 20. Charging devices 10*a*, 10*b* can be similar to charging device 10 in FIG. 1, and generate corona so as to uniformly charge photoreceptor belt 20 to a substantially uniform potential determined by the voltage potential of their grids. Exposing devices 60*a*, 60*b* can be, for example, laser raster output scanners which include a laser, a rotating polygon mirror and a suitable modulator or, in lieu thereof, a light emitting diode array (LED) as a write bar. Developer devices 70*a*, 70*b* can be any of various known types of developer devices for using powder or liquid toner. A cleaning device 72 and a precharge erase lamp 74, conventional in the art, are also provided upstream of the first charging device 10*a* with respect to direction P in which photoreceptor 20 rotates.

During normal image forming operation, photoreceptor 20 is charged to a first voltage potential (e.g., 600 volts) by first charging device 10*a*. A latent image is formed on photoreceptor 20 by first exposing device 60*a*. The first latent image is then developed into a first toner image by first developer device 70*a*. Second charging device 10*b* then recharges photoreceptor 20 to a predetermined voltage potential which can be the same as or different from the first voltage potential to which first charging device 10*a* charged photoreceptor 20. Accordingly, the second (as well as any subsequent charging devices which may be provided along the periphery of a photoreceptor)is also referred to herein as a recharging device. After recharging photoreceptor 20, a second latent image is formed (typically over the first toner image) by second exposing device 60*b*. The second latent image is then toner developed to form a second toner image by second developer device 70*b*. The two-colored image is then transferred to a support material 78 such as, for example, a sheet of paper by a transfer corotron 76 as is well known in the art. Support material 78 is conveyed past photoreceptor 20 in the direction indicated by arrow Q. Any residual toner remaining on photoreceptor is removed therefrom by cleaning device 72. The photoreceptor is then discharged by applying light to the photoreceptor by erase lamp 74. The process can then be repeated for another multicolor image.

During multicolor printing operations, as described above, where the photoreceptor is recharged while it contains a first toner developed latent image thereon, it is sometimes highly desirable to recharge the photoreceptor, prior to the formation of second (and subsequent) latent images thereon, to a voltage potential related to the voltage potential of background are as of the first image. These background areas correspond to portions of the first image which were not exposed to light, and therefore have a voltage potential equal to the voltage potential to which the photoreceptor was charged by the first charging device minus any loss of potential due to dark decay (this reduced photoreceptor potential is referred to as $V_{ddp}$). Depending on the type of printing machine, toner, etc., it may be desirable to recharge the photoreceptor to $V_{ddp}$ or to some potential related to $V_{ddp}$ (e.g., $V_{ddp}+30$ V) with the second charging device. Accordingly, using the present invention, the appropriate second charging grid potential needed to achieve this photoreceptor charging level can be determined directly.

It is also desirable to know the photoreceptor potential at other points along the path of photoreceptor 20 (e.g., at each developer device, etc.) Since the speed of photoreceptor 20 is known and relatively constant, the amount of time required for a portion of the photoreceptor to move between first charging device 10*a* and second charging device 10*b* is known or can be determined easily. By using the present invention to determine the voltage potential $V_{ddp}$ Of the photoreceptor 20 adjacent to second charging device 10*b*, and knowing the time required for this amount of dark decay to occur, the dark decay temporal characteristics of photoreceptor 20 can be determined. That is, the amount of voltage potential decay which occurs in the time required for the photoreceptor to move between charging devices 10*a* and 10*b* can be used to predict the voltage potential of the photoreceptor at other locations along its periphery such as, for example, upstream of ROSs 60a, 60b and developer devices 70a, 70b. This is in addition to the voltage potential of the photoreceptor at second charging device 10b which is directly determined (instead of predicted).

Figure 3:
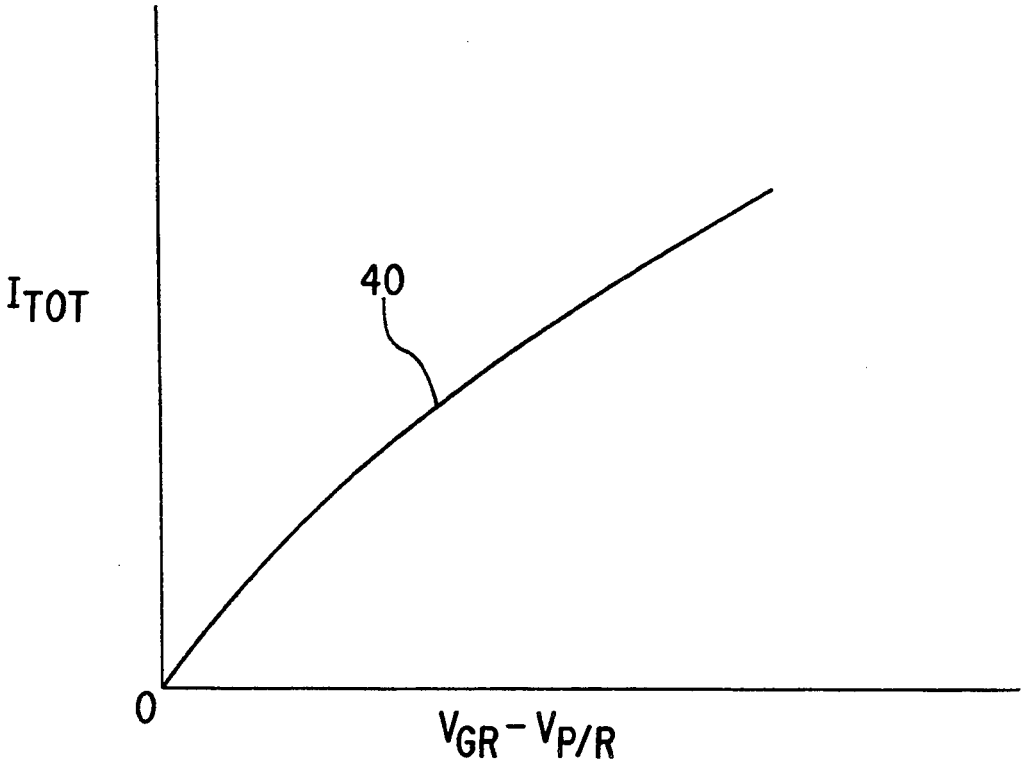
FIG. 3 is a graph illustrating the relationship between total current supplied to the charging device and a voltage differential between photoreceptor voltage potential input to the charging device and a voltage potential of a grid of the photoreceptor charging device.

FIG. 3 is a graph illustrating the relationship between total scorotron current $I_{TOT}$ measured by ammeters 32,34 and the difference between grid voltage $V_{GR}$ and the photoreceptor voltage $V_{P/R}$ incoming into the scorotron. As illustrated by line 40, the total current $I_{TOT}$, supplied to coronodes 12a, 12b (measured by ammeter 32) and grid 16 (measured by ammeter 34)is related to the difference between the voltage to which grid 16 is charged and the photoreceptor input voltage potential. In particular, when the grid voltage potential is equal to the voltage potential of the photoreceptor, the total scorotron current $I_{TOT}$ is small or zero. This relationship is in accordance with the well-known operation of charging devices such as, for example, scorotrons. Thus, since the voltage potential of the grid 16 can be maintained substantially constant, measuring the total scorotron current $I_{TOT}$ can be used to determine the voltage potential of the photoreceptor ($V_{P/R}$) adjacent to the charging device. Thus, for example, the CPU 25 illustrated in FIG. 1 is used to determine the potential of a portion of photoreceptor 20 (adjacent to second charging device 10b in FIG. 2, for example) using the relationship illustrated in FIG. 3 from the sum of the coronode current measured by ammeter 32 and the grid current measured by ammeter 34.

In order for the voltage potential measured at second charging device 10b to be representative of the dark decay voltage potential, $V_{ddp}$, measurements must be taken on a portion of photoreceptor 20 which was not exposed to light. This can be done by making such measurements during the set up time of the printing machine or between documents (the interdocument time). Additionally, second charging device 10b should be operated to charge photoreceptor 20 to the same voltage potential as first charging device 10a during the above-described measurement process (although the second charging device 10b may charge the photoreceptor 20 to a different voltage potential during normal image forming operation).

CPU 25 can derive the photoreceptor voltage potential using the graph illustrated in FIG. 3, or using an equation representative of the FIG. 3 graph depending on the amount of time available for processing.

Figure 4:
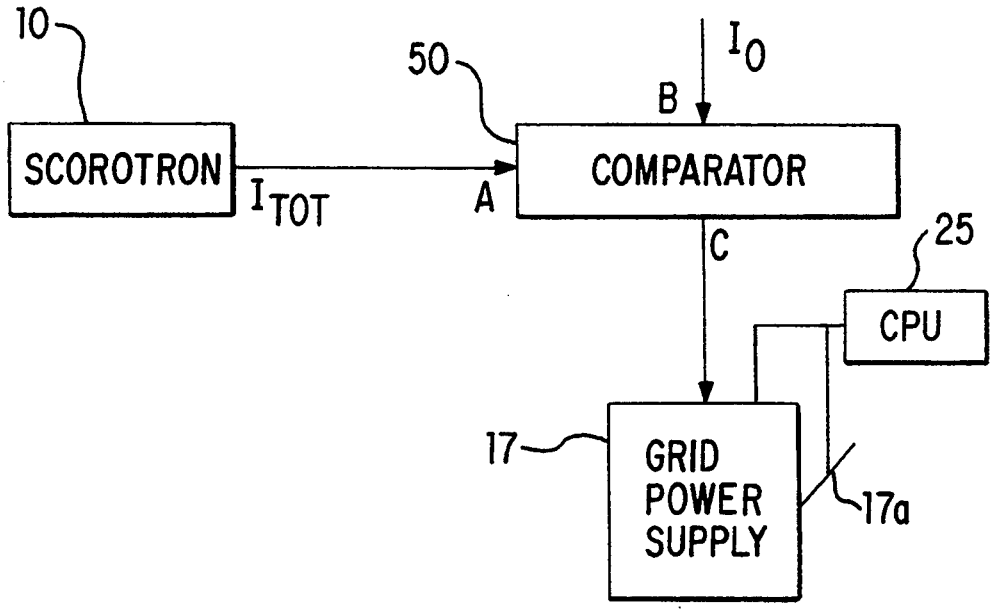
FIG. 4 is a block diagram of a second embodiment of the present invention for varying the grid voltage until the total current to the charging device becomes a predetermined value.

The function illustrated in FIG. 3 can be unstable for total scorotron currents, $I_{TOT}$, further away from zero, depending on the type and condition of photoreceptor. Hence, a more accurate measurement is made when the second scorotron grid voltage $V_{P/R}$ is operated at voltages close to the incoming photoreceptor voltage $V_{P/R}$ (i.e., at low $I_{TOT}$ currents). Additionally, a second embodiment, illustrated in FIG. 4, can be used to more accurately determine the photoreceptor voltage potential adjacent to a charging device. The circuit illustrated in FIG. 4 provides a closed loop system for varying the voltage output to grid 16 by grid power supply 17 until the total scorotron current $I_{TOT}$ becomes some predeterminedly small value. When total scorotron current $I_{TOT}$ is small, the voltage potential of grid 16 is substantially equal to the voltage potential of the portion of photoreceptor 20 located adjacent to the charging device.

Accordingly, as shown in FIG. 4, the total scorotron current, $I_{TOT}$ supplied to charging device 10 is fed to a first input, A, of a comparator 50. Comparator 50 can be, for example, a conventional operational amplifier. A reference signal $I_O$, representative of, for example, zero or a predetermined, small current is supplied to a second input B, of comparator 50. Output C of comparator 50 supplies an output signal to grid power supply 17. When A>B, comparator output C goes high. When A<B, comparator output C goes low. When A=B, the output C of comparator 50 equals the value necessary to drive the grid power supply 17 to the grid voltage $V_{GR}$ equal to the incoming photoreceptor voltage $V_{P/R}$. Under normal (image forming) operation, grid power supply 17 outputs a constant voltage to grid 16 so that grid 16 is maintained at a relatively constant voltage potential. However, during measurement of the voltage potential of photoreceptor 20, in accordance with the second embodiment of the present invention, CPU 25 controls a switch 17a in grid power supply so that the voltage output by grid power supply 17 varies in accordance with the signal supplied from the output C of comparator 50 until the values A=B. When this occurs, the voltage potential of grid 16 is measured, and is substantially equal to the voltage potential of photoreceptor 20 ($V_{ddp}$). After the measurement operation is performed, CPU 25 actuates switch 17a so that grid power supply 17 returns to normal operation and outputs a constant voltage to grid 16 so that image formation can be performed.

Based on the photoreceptor voltage potential determined above, CPU 25 may reset grid power supply 17 to provide a different grid voltage potential, and/or may control the developer bias used in the developer devices or the exposure levels used by the exposing devices in the printing machine.

The photoreceptor potential determined using a charging device can also be used to derive a dark decay characteristic of the photoreceptor so that the photoreceptor voltage potential can be predicted at other points along its path (e.g., at points downstream of the charging device). Different photoreceptor types have different functional dependencies. A typical dependency is exponential, e.g., $V_{P/R}=V_O[1\text{-}A(1\text{-}e^{-Bt})]$, where A and B are parameters of the photoreceptor type and its life status, respectively. In order to predict the voltage at any point in time one would theoretically have to take measurements at two points in time (beyond the initial t=0 $V_O$ grid knowledge). Therefore, either the actual photoreceptor values A and B must be characterized and parametrized so that a single voltage measurement derives both A and B, or a single measurement can be made at a time small enough so that $V_{P/R}=V_O$ (1-Ct), where C=A*B, and is thus a single adjustable parameter requiring only one measurement to be determined. Preferably, the relationship between the photoreceptor voltage at different locations can be derived empirically, and then this relationship can be used to predict the photoreceptor potential at one point (e.g. adjacent to a developer housing) from measurements made at another point (e.g., adjacent to a charging device).

The above examples assume that there is no offset between the values of photoreceptor voltage $V_O$ (=$V_{P/R}$ in FIG. 4) and the grid potential ($V_{GR}$) when total scorotron current ($I_{TOT}$)is 0 (i.e., it is assumed that line 40 in FIG. 3 passes through the origin). Usually, there is some offset between $V_O$ and $V_{GR}$, which needs to be taken into account when deriving $V_{ddp}$. If the offset is either known or predictable (e.g., $V_{GR}=V_O-V_{OFFSET}$ at $I_{TOT}=0$), then it is a straight forward algebraic transformation between the measurement techniques described for the offset and non-offset cases.

Even when the offset is unknown, the following measurements can be made. First, if two sequential charging equivalent devices (with assumed equal offsets) are set at zero current conditions (i.e., $I_{TOT}$32 0), then the difference between $V_{GR}$ of the two sequential charging devices is equal to the photoreceptor voltage drop due to dark decay between the two sequential charging devices. Thus, the dark decay characteristics of the photoreceptor can be derived, and photoreceptor potential can be predicted at various locations along the photoreceptor path. Second, if the input photoreceptor voltage to a first charging device (e.g., charging device 10*a* in FIG. 2)is known, then if the total currents ($I_{TOT}$) to both the first charging device and the next charging device (which acts as a recharging device) are set to be the same, the difference between $V_{GR}$ of the two charging devices is approximately equal to the dark decay difference between the two charging devices.

The present invention thus enables the state of the photoreceptor potential to be measured and/or predicted at various locations along the path of the photoreceptor using charging/recharging devices already existing in the printing machine. ESVs are not required, and thus the overall cost of the printing machine is reduced. Additionally, by enabling changes in the dark decay characteristic of a photoreceptor to be monitored and compensated for over the passage of time, improved print quality can be achieved and maintained.

Figure 5:
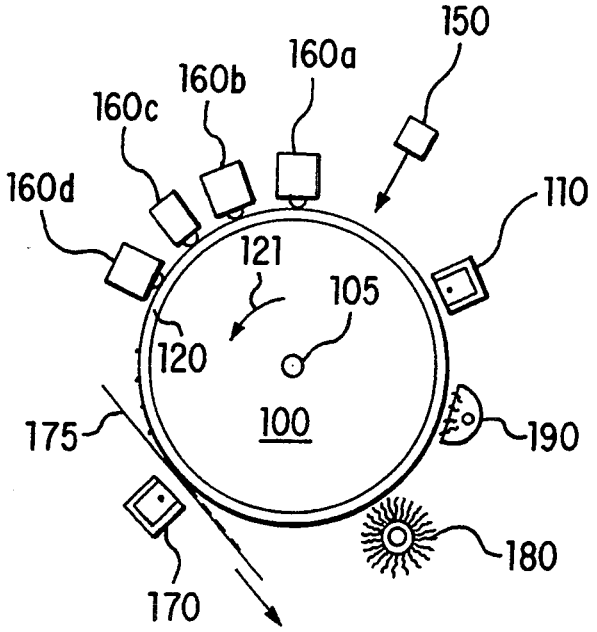
FIG. 5 is a schematic elevational view of a multi-pass color printing machine having a single charging device, single exposing device and four developer devices for use with the present invention.

FIG. 5 illustrates a multi-pass printing machine having a drum type photoreceptor 100, a single charging device 110, a single exposing device 150 and four different color developer devices 160*a*, 160*b*, 160*c*, 160*d*. Drum 100 is mounted for rotation about shaft 105 in the direction of arrow 121, and includes a photoreceptor outer surface 120. A cleaning device 180 which is selectively movable towards or away from drum 100 and a discharge lamp 190 are provided for cleaning and discharging the photoreceptor 120 after a multicolor image is transferred to a sheet of paper 175 by scorotron 170 in a conventional manner. Cleaning device 180 and discharge lamp 190 do not operate during the plural revolutions required to form a multicolor image.

As is well known, in order to form a multicolor image, drum 100 rotates a single time for each color in the final image. Thus, in order to form a four color image, the drum rotates four times. Each time the drum rotates, it is charged by charging device 110, exposed by exposing device 150 to form a latent image on photoreceptor surface 120 which is selectively developed by one of developer devices 160*a*–160*d* depending on the color of that image. Once all four toner images are formed (usually one on top of the other) on photoreceptor surface 120, the composite, multicolor image is transferred to paper sheet 175. After transfer of the image, cleaning device 180 removes any residual toner from photoreceptor surface 120, and then lamp 190 discharges photoreceptor surface 192. Lamp 190 usually does not discharge photoreceptor surface 120 between each of the individual imaging cycles used to form a single multicolor image. Thus, charging device 110 charges photoreceptor surface 120 from about zero potential up to the full electrostatic potential (e.g., 600 V) prior to formation of the first latent image, but merely recharges photoreceptor surface 120 prior to formation of subsequent latent and toner images. The potential to which charging device 110 charges photoreceptor surface 120 for each of the latent images (first-fourth) may differ. For example, the voltage potential may increase with each additional color image.

In order to practice the present invention in the multipass printing machine having a single charging device 110 illustrated in FIG. 5, charging device 110 is controlled so as to charge photoreceptor surface 120 to a first voltage potential. As portions of photoreceptor surface 120 which have been charged to the first voltage potential but have not have been exposed to light return to the location of charging device 110 (due to rotation of drum 100), they will experience a drop in voltage potential down to $V_{ddp}$ due to dark decay characteristics of photoreceptor surface 120. Thus, in accordance with the first embodiment of the present invention, the dark decay voltage potential $V_{ddp}$ of photoreceptor surface 120 can be determined by measuring the current $I_{TOT}$ supplied to the charging device 110 in order to recharge the photoreceptor back up to the first voltage potential. Alternatively, in accordance with the second embodiment of the present invention illustrated in FIG. 4, the voltage potential of the grid of charging device 110 can be varied until the total current to charging device 110 ($I_{TOT}$), becomes small. Since the circuit of FIG. 4 operates very quickly, the voltage potential of the charging device grid drops to the photoreceptor voltage potential ($V_{ddp}$) almost instantaneously. Accordingly, the lower potential to which charging device 110 charges photoreceptor 120 surface (i.e., during the measuring process in accordance with the second embodiment of the present invention) does not adversely effect the voltage potential measurement process.

Figure 6:
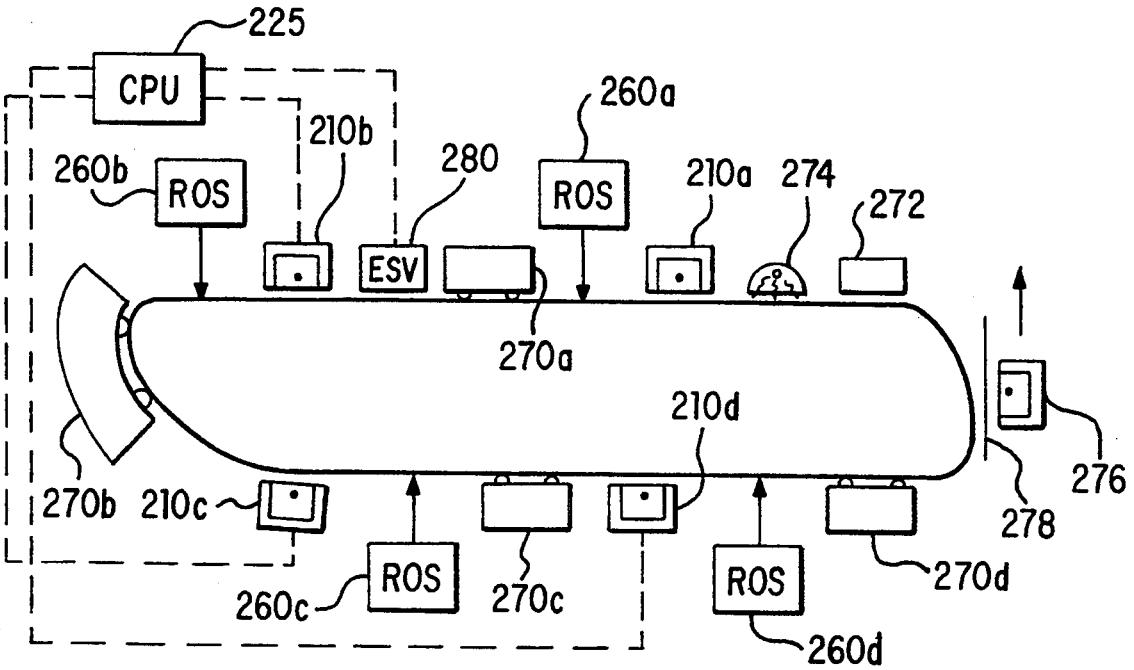
FIG. 6 is a schematic representation of a single-pass four-color printing machine usable with the present invention.

FIG. 6 illustrates a single-pass printing machine capable of printing with four different colors. The printing machine includes a belt-type photoreceptor 220 having four charging devices 210*a*, 210*b*, 210*c*, 210*d*, four exposing devices 260*a*, 260*b*, 260*c*, 260*d* and four developer devices 270*a*, 270*b*, 270*c*, 270*d* arranged around the periphery of belt 220. After the fourth toner image is formed by fourth developer device 270*d* (on top of the first, second and third toner images), the multicolor toner image is transferred to a sheet 278 by a conventional scorotron 276. Any residual toner remaining on photoreceptor 220 is removed by cleaning device 272, and then photoreceptor 220 is uniformly discharged by erase lamp 274. First charging device 210*a* then charges photoreceptor 220 to a first voltage potential, as described above with respect to FIGS. 2 and 5. Thus, first charging device 210*a* can be considered to be a charging device whereas second-fourth charging devices 210*b*, 210*c*, 210*d* can be considered to be recharging devices since they do not usually recharge the entire photoreceptor from zero potential. Although the printing machine of FIG. 6 is more expensive than the FIG. 5 printing machine, it is capable of printing at a higher rate since only a single circulation of the photoreceptor is required in order to print a four color image on sheet 278.

The potential of the portions of photoreceptor 220 located adjacent to recharging devices 210*b*, 210*c*, 210*d* can be determined by CPU 225, which monitors the coronode and grid currents, and grid potential of recharging devices 210*b*, 210*c*, 210*d* in accordance with the present invention as described above with respect to FIGS. 2 and 5.

Additionally, in the FIG. 6 embodiment, wherein a single-pass four color printer is provided, it is also preferable to include at least one ESV 280 which also provides a reading of the photoreceptor potential adjacent thereto. This measurement is also provided to CPU 225 for use in determining dark decay characteristics of photoreceptor 220. Since the ESV is capable of measuring absolute photoreceptor voltages accurately, the ESV measurement can be used to measure directly the offset voltage, $V_{OFFSET}$, for at least one of the scorotrons (210*b*). Assuming that equivalent scorotrons have equal offsets, this measured offset value can be used to enable all of the other scorotrons to measure their respective voltages without the need for several ESVs.

In addition to determining the dark decay characteristics of photoreceptor 220 by measuring the charging device total current or grid potential of one of the recharging devices 210*b*, 210*c*, 210*d* after charging photoreceptor 220 to a first voltage potential using first charging device 210*a*, in the FIG. 6 embodiment, dark decay characteristics of photoreceptor 220 can also be determined by comparing the operation of two of the recharging devices 210*b*, 210*c*, 210*d* with one another. For example, as described above, when two sequential charging devices are set at zero current conditions ($I_{TOT}=0$), then the difference between $V_{GR}$ of the two sequential charging devices is equal to the photoreceptor voltage drop due to dark decay between the two sequential charging devices. Thus, the dark decay characteristics of photoreceptor 220 can be derived, and photoreceptor potential can be predicted at various locations along the photoreceptor path.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A method of determining a voltage potential of a portion of a photoreceptor adjacent to a photoreceptor charging device comprising the steps of:

measuring a current supplied from a power supply to said photoreceptor charging device in order for said photoreceptor charging device to charge said portion of the photoreceptor to a predetermined voltage potential; and deriving the voltage potential of said portion of the photoreceptor from said measured current.

2. The method of claim 1, wherein the voltage potential of said portion of the photoreceptor is derived from said measured current by using a predetermined correlation between total charging device current and a voltage differential between photoreceptor voltage potential input to the charging device and a voltage potential of a grid of said photoreceptor charging device.

3. A method of determining a voltage potential of a portion of a photoreceptor adjacent to a photoreceptor charging device, comprising the steps of:

charging the photoreceptor to a first voltage potential a first time;

using said photoreceptor charging device, charging the photoreceptor to the first voltage potential a second time, later than said first time, without imagewise exposing at least said portion of the photoreceptor between said first and said second times so that an unexposed portion of the photoreceptor experiences dark decay;

measuring a current supplied to said photoreceptor charging device during said second time; and deriving the voltage potential of said unexposed portion of the photoreceptor from said measured current.

4. The method of claim 3, wherein the voltage potential of said unexposed portion of the photoreceptor is derived from said measured current by using a predetermined correlation between total charging device current and a voltage differential between photoreceptor voltage potential input to the charging device and a voltage potential of a grid of said photoreceptor charging device.

5. The method of claim 3, wherein said photoreceptor charging device is also used to charge the photoreceptor to said first voltage potential said first time.

6. The method of claim 3, wherein said photoreceptor charging device is a first photoreceptor charging device, and a second charging device is used to charge the photoreceptor to said first voltage potential said first time.

7. The method of claim 6, wherein said first photoreceptor charging device is normally used to charge the photoreceptor to a predetermined voltage potential different from said first voltage potential when image formation is taking place.

8. The method of claim 6, wherein said photoreceptor is moved between said first time and said second time so that said portion of the photoreceptor is moved from said second charging device to said first photoreceptor charging device.

9. A method of determining a voltage potential of a portion of a photoreceptor adjacent to a photoreceptor charging device comprising the steps of:

varying a voltage supplied to a grid of said photoreceptor charging device until a current supplied to said photoreceptor charging device becomes a predetermined value; and deriving the voltage potential of said portion of the photoreceptor from a voltage potential of said grid when the current supplied to the photoreceptor charging device becomes the predetermined value.

10. The method of claim 9, wherein the derived voltage potential of said portion of the photoreceptor is about equal to said voltage potential of said grid when the current supplied to the photoreceptor charging device becomes the predetermined value.

11. A method of determining a voltage potential of a portion of a photoreceptor adjacent to a photoreceptor charging device, comprising the steps of:

charging the photoreceptor to a first voltage potential a first time;

using said photoreceptor charging device, charging the photoreceptor a second time, later than said first time, without imagewise exposing at least said portion of the photoreceptor between said first and said second times so that an unexposed portion of the photoreceptor experiences dark decay;

during said second time, varying a voltage supplied to a grid of said photoreceptor charging device until a current supplied to said photoreceptor charging device becomes a predetermined value; and deriving the voltage potential of said portion of the photoreceptor from a voltage potential of said grid when the current supplied to the photoreceptor charging device becomes the predetermined value.

12. The method of claim 11, wherein the derived voltage potential of said portion of the photoreceptor is about equal to said voltage potential of said grid when the current supplied to the photoreceptor charging device becomes the predetermined value.

13. The method of claim 11, wherein said photoreceptor charging device is also used to charge the photoreceptor to said first voltage potential said first time.

14. The method of claim 11, wherein said photoreceptor charging device is a first photoreceptor charging device, and a second charging device is used to charge the photoreceptor to said first voltage potential said first time.

15. The method of claim 14, wherein said first photoreceptor charging device is normally used to charge the photoreceptor to a predetermined voltage potential different from said first voltage potential when image formation is taking place.

16. The method of claim 14, wherein said photoreceptor is moved between said first time and said second time so that said portion of the photoreceptor is moved from said second charging device to said first photoreceptor charging device.

17. A method of determining a voltage potential of a portion of a photoreceptor adjacent to a photoreceptor recharging device in an imaging device having said photoreceptor, said photoreceptor recharging device, a photoreceptor charging device, first and second exposing devices for exposing said photoreceptor to image modulated light so as to form a latent image on the photoreceptor, and first and second developer devices for toner developing latent images formed on the photoreceptor, each of said developer devices having a different colored toner, said first exposing device and said first developer device being located downstream of said charging device, said second exposing device and said second developer device being located downstream of said recharging device, said recharging device normally being used to charge the photoreceptor to a predetermined voltage potential after a first toner image is formed by said first developer device on a first latent image formed on the photoreceptor by said first exposing device but before a second latent image is formed on the first toner image by said second exposing device, said method comprising the steps of:

charging said photoreceptor to a first voltage potential using said photoreceptor charging device;

moving said photoreceptor toward said photoreceptor recharging device without imagewise exposing at least a portion of said photoreceptor, an unexposed portion of the photoreceptor experiencing dark decay as said photoreceptor is moved;

measuring a current supplied to said photoreceptor recharging device in order for said photoreceptor recharging device to charge said unexposed portion of the photoreceptor to said first voltage potential; and deriving the voltage potential of said portion of the photoreceptor from said measured current.

18. The method of claim 17, wherein the voltage potential of said portion of the photoreceptor is derived from said measured current by using a predetermined correlation between total recharging device current and a voltage differential between photoreceptor voltage potential input to the recharging device and a voltage potential of a grid of said photoreceptor recharging device.

19. The method of claim 17, wherein the predetermined voltage potential to which said photoreceptor recharging device normally charges the photoreceptor when image formation is taking place is different from said first voltage potential.

20. A method of determining a voltage potential of a portion of a photoreceptor adjacent to a photoreceptor recharging device in an imaging device having said photoreceptor, said photoreceptor recharging device, a photoreceptor charging device, first and second exposing devices for exposing said photoreceptor to image modulated light so as to form a latent image on the photoreceptor, and first and second developer devices for toner developing latent images formed on the photoreceptor, each of said developer devices having a different colored toner, said first exposing device and said first developer device being located downstream of said charging device, said second exposing device and said second developer device being located downstream of said recharging device, said recharging device normally being used to charge the photoreceptor to a predetermined voltage potential after a first toner image is formed by said first developer device on a first latent image formed on the photoreceptor by said first exposing device but before a second latent image is formed on the first toner image by said second exposing device, said method comprising the steps of:

charging said photoreceptor to a first voltage potential using said photoreceptor charging device;

moving said photoreceptor toward said photoreceptor recharging device without imagewise exposing at least a portion of said photoreceptor, an unexposed portion of the photoreceptor experiencing dark decay as said photoreceptor is moved;

varying a voltage supplied to a grid of said photoreceptor recharging device until a current supplied to said photoreceptor recharging device becomes a predetermined value; and deriving the voltage potential of said portion of the photoreceptor from a voltage potential of said grid when the current supplied to the photoreceptor recharging device becomes the predetermined value.

21. The method of claim 20, wherein the derived voltage potential of said portion of the photoreceptor is about equal to said voltage potential of said grid when the current supplied to the photoreceptor charging device becomes the predetermined value.

22. The method of claim 20, wherein the predetermined voltage potential to which said photoreceptor recharging device normally charges the photoreceptor when image formation is taking place is different from said first voltage potential.

23. A method of controlling an imaging device capable of forming multicolor images, said imaging device having a photoreceptor, at least one charging device for charging said photoreceptor, said at least one charging device having a coronode and a grid, at least one exposing device for exposing said photoreceptor to image modulated light so as to form a latent image on the photoreceptor, and a plurality of developer devices for toner developing latent images formed on the photoreceptor, each of said plurality of developer devices having a different colored toner, said at least one charging device, said at least one exposing device and said plurality of developer devices located adjacent to and along a periphery of said photoreceptor, said imaging device forming multicolor images by charging said photoreceptor, imagewise exposing said charged photoreceptor to form a latent image and toner developing the latent image with one of said developer devices for each color in the multicolor image so that a plurality of single color toner images are layered on top of each other on said photoreceptor, said method comprising the steps of:

determining a photoreceptor voltage potential dark decay characteristic of said photoreceptor using said at least one charging device; and adjusting one or more operating parameters of said imaging device based on the determined photoreceptor voltage potential dark decay characteristic.

24. The method of claim 23, wherein one of the operating parameters is a grid voltage used by the grid of said at least one charging device for controlling the voltage potential to which said photoreceptor is charged between two successive toner image formation operations during formation of one multicolor image.

25. The method of claim 23, wherein one of the operating parameters is a developer housing bias voltage used in said developer devices.

26. The method of claim 23, wherein one of the operating parameters is an exposure level used by said at least one exposing device.

27. The method of claim 23, wherein said step of determining the photoreceptor voltage potential dark decay characteristic of said photoreceptor includes deriving a voltage potential of a portion of the photoreceptor by:

charging at least said portion of said photoreceptor to a predetermined voltage potential a first time and a second time with said at least one charging device while moving said photoreceptor, but without exposing said portion of said photoreceptor, an unexposed portion of the photoreceptor experiencing dark decay as said photoreceptor is moved;

measuring a total current supplied to the coronode and to the grid of said at least one charging device in order for said at least one charging device to charge said unexposed portion of the photoreceptor to said predetermined voltage potential said second time; and deriving the voltage potential of said unexposed portion of the photoreceptor from said measured total current, said voltage potential of the unexposed portion of the photoreceptor being indicative of the photoreceptor voltage potential dark decay characteristic of said photoreceptor.

28. The method of claim 27, wherein the voltage potential of said unexposed portion of the photoreceptor is derived from said measured total current by using a predetermined correlation between total charging device current and a voltage differential between photoreceptor voltage potential input to the at least one charging device and a voltage potential of the grid of said at least one charging device.

29. The method of claim 27, wherein at least two charging devices and a corresponding number of exposing devices and developer devices are provided, a first of said charging devices located upstream of a first of the exposing devices and a first of the developer devices, and a second of said charging devices located downstream of the first exposing device and the first developer device, said photoreceptor being charged to said predetermined voltage potential said first time by said first charging device and being charged to said predetermined voltage potential said second time by said second charging device, said grid current supplied to the coronode and to the grid of the second charging device being measured in order to derive the voltage potential of said unexposed portion of the photoreceptor.

30. The method of claim 23, wherein said step of determining the photoreceptor voltage potential dark decay characteristic of said photoreceptor includes deriving a voltage potential of a portion of the photoreceptor by:

charging at least said portion of said photoreceptor to a predetermined voltage potential a first time and a second time with said at least one charging device while moving said photoreceptor, but without exposing said portion of said photoreceptor, an unexposed portion of the photoreceptor experiencing dark decay as said photoreceptor is moved;

during said second time, varying a voltage supplied to the grid of said at least one charging device until a total current equal to the sum of the current supplied to the coronode and to the grid becomes a predetermined value; and deriving the voltage potential of said unexposed portion of the photoreceptor from a voltage potential of said grid when the total of the current supplied to the coronode and to the grid of the at least one charging device becomes the predetermined value.

31. The method of claim 30, wherein the derived voltage potential of said unexposed portion of the photoreceptor is about equal to said voltage potential of said grid when the total current becomes the predetermined value.

32. The method of claim 30, wherein a single charging device is provided, said single charging device charging said photoreceptor to said predetermined voltage potential said first time and said second time.

33. The method of claim 30, wherein at least two charging devices and a corresponding number of exposing devices and developer devices are provided, a first of said charging devices located upstream of a first of the exposing devices and a first of the developer devices, and a second of said charging devices located downstream of the first exposing device and the first developer device, said photoreceptor being charged to said predetermined voltage potential said first time by said first charging device and being charged to said predetermined voltage potential said second time by said second charging device, said voltage supplied to the grid of the second charging device being varied until a total current supplied to the coronode and to the grid of the second charging device becomes the predetermined value in order to derive the voltage potential of said unexposed portion of the photoreceptor from the voltage potential of the grid of the second charging device.

34. The method of claim 23, wherein at least two charging devices and a corresponding number of exposing devices and developer devices are provided, a first of said charging devices located upstream of a first of the exposing devices and a first of the developer devices, and a second of said charging devices located downstream of the first exposing device and the first developer device, said photoreceptor voltage potential dark decay characteristic of said photoreceptor being determined using measurements obtained from said second charging device.

35. The method of claim 23, further comprising calibrating said at least one charging device by comparing a voltage potential of said photoreceptor measured using the at least one charging device with a voltage potential of said photoreceptor measured with an electrostatic voltmeter.

36. Apparatus for determining a voltage potential of a photoreceptor comprising:

a photoreceptor charging device having a coronode and a grid for placement between the coronode and a photoreceptor;

a current measuring device coupled to a supply line that supplies power to said photoreceptor charging device, said current measuring device measuring current supplied to said photoreceptor charging device; and a processor that determines the voltage potential of the portion of the photoreceptor from the current measured by said current measuring device.

37. The apparatus of claim 36, wherein said current measuring device measures a total current supplied to the coronode and to the grid of said photoreceptor charging device in order for said photoreceptor charging device to charge the portion of the photoreceptor to a predetermined voltage potential; and said processor derives the voltage potential of the portion of the photoreceptor from said measured total current.

38. The apparatus of claim 37, wherein said processor derives the voltage potential of the portion of the photoreceptor from said measured total current by using a predetermined correlation between total charging device current and a voltage differential between photoreceptor voltage potential input to the charging device and a voltage potential of the grid of said photoreceptor charging device.

39. The apparatus of claim 36, further comprising an electrostatic voltmeter located adjacent to the photoreceptor for measuring the voltage potential of the photoreceptor, and wherein said processor calibrates the current supplies to the charging device used to determined the voltage potential of the portion of the photoreceptor based on the voltage potential measured by said electrostatic voltmeter.

40. Apparatus for determining a voltage potential of a portion of a photoreceptor comprising:

a photoreceptor charging device having a coronode and a grid for placement between the coronode and a photoreceptor;

means for varying a voltage supplied to the grid of said photoreceptor charging device until a total current supplied to said photoreceptor charging device becomes a predetermined value; and means for deriving the voltage potential of said portion of the photoreceptor from a voltage potential of the grid when the total current supplied to the photoreceptor charging device becomes the predetermined value.

41. The apparatus of claim 40, wherein the derived voltage potential of said portion of the photoreceptor derived by said means for deriving is about equal to the voltage potential of the grid when the current supplied to the photoreceptor charging device becomes the predetermined value.

42. Apparatus for determining a voltage potential of a portion of a photoreceptor comprising:

a photoreceptor charging device having a coronode and a grid for placement between the coronode and a photoreceptor;

means for determining the voltage potential of the portion of the photoreceptor from an operating condition of said photoreceptor charging device; and control means for controlling said photoreceptor charging device to charge the photoreceptor to a predetermined voltage potential a first time and a second time later than said first time, without imagewise exposing at least said portion of the photoreceptor between said first and second times so that an unexposed portion of the photoreceptor experiences dark decay, and for controlling said determining means to determine the voltage potential of the portion of the photoreceptor from the operating condition of said photoreceptor charging device the second time the photoreceptor is charged to the predetermined voltage potential.

43. Apparatus for determining a voltage potential of a portion of a photoreceptor comprising:

a photoreceptor charging device for charging the photoreceptor to a predetermined voltage potential a first time;

a photoreceptor recharging device, for placement downstream of said photoreceptor charging device with respect to a direction in which the photoreceptor moves, and having a coronode and a grid for placement between the coronode and the photoreceptor; and means for determining the voltage potential of the portion of the photoreceptor from an operating condition of said photoreceptor recharging device.

44. The apparatus of claim 43, wherein said means for determining includes:

means for measuring a total current supplied to the coronode and to the grid of said photoreceptor recharging device in order for said photoreceptor recharging device to charge the portion of the photoreceptor to the predetermined voltage potential a second time later than the first time; and means for deriving the voltage potential of the portion of the photoreceptor from said measured total current.

45. The apparatus of claim 44, wherein said means for deriving the voltage potential derives the voltage potential of the portion of the photoreceptor from said measured total current by using a predetermined correlation between total charging device current and a voltage differential between photoreceptor voltage potential input to the recharging device and a voltage potential of the grid of said photoreceptor recharging device.

46. The apparatus of claim 43, wherein said means for determining includes:

means for varying a voltage supplied to the grid of said photoreceptor recharging device until a total current supplied to the coronode and to the grid of said photoreceptor recharging device becomes a predetermined value; and means for deriving the voltage potential of said portion of the photoreceptor from a voltage potential of the grid when the total current becomes the predetermined value.

47. The apparatus of claim 46, wherein the derived voltage potential of said portion of the photoreceptor derived by said means for deriving is about equal to the voltage potential of the grid when the total current becomes the predetermined value.

* * * * *